US005519476A

United States Patent [19]

Dalal et al.

[11] Patent Number: 5,519,476

[45] Date of Patent: May 21, 1996

[54] LIQUID ELECTROPHOTOGRAPHIC REPRODUCTION MACHINE HAVING A DESIRED ABRASION FIX LEVEL

[75] Inventors: Edul N. Dalal; John S. Berkes, both of Webster; Kristen M. Natale, Rochester, all of N.Y.

[73] Assignee: Xerox Corporation, Stamford, Conn.

[21] Appl. No.: 482,691

[22] Filed: Jun. 7, 1995

[51] Int. Cl.[6] ..... G03G 15/22; G03G 15/16

[52] U.S. Cl. ..... 355/279; 355/256; 355/290

[58] Field of Search ..... 355/279, 256, 355/257, 285, 290

[56] References Cited

U.S. PATENT DOCUMENTS 5,028,964 7/1991 Landa et al. ..... 355/273

*Primary Examiner*—Nestor R. Ramirez
*Attorney, Agent, or Firm*—Tallam I. Nguti

[57] ABSTRACT

A liquid electrophotographic reproduction machine for producing a toner image reproduction on a copy sheet. The reproduction machine includes an image bearing member movable along a process path, latent image forming devices mounted along the process path for forming a latent image electrostatically on the image bearing member, and a development unit. The development unit is mounted along the process path and contains liquid developer material including a liquid carrier and charged dispersed toner particles for developing the latent image to form a toner image. The reproduction machine also includes a transfix assembly mounted along the process path for transferring and simultaneously heating and fixing the toner image onto a copy sheet. In order to increase the abrasion fix level of produced toner image copies, the reproduction machine further includes a separate fusing apparatus mounted downstream of the transfix assembly relative to copy sheet movement for selectively and additionally heating and pressurizing the transfixed image onto the copy sheet.

5 Claims, 2 Drawing Sheets

LIQUID ELECTROPHOTOGRAPHIC REPRODUCTION MACHINE HAVING A DESIRED ABRASION FIX LEVEL

BACKGROUND OF THE INVENTION

This invention relates to electrostatographic reproduction machines, and more particularly to a liquid electrophotographic reproduction machine producing toner image reproductions having a desiredly high abrasion fix level.

Liquid electrophotographic reproduction machines are well known, and generally each include a development system that utilizes a liquid developer material typically having about 2 percent by weight of fine solid particulate toner material dispersed in a liquid carrier. The liquid carrier is typically a hydrocarbon. In the electrophotographic process of such a machine, a latent image formed on an image bearing member or photoreceptor is developed with the liquid developer material. The developed image on the photoreceptor typically contains about 12 percent by weight of particulate toner in liquid hydrocarbon carrier. To improve the quality of transfer of the developed image to a receiver, the image is conditioned so as to increase the percent solids of the liquid developer forming the image to about 25 percent. Such conditioning is achieved by removing excess hydrocarbon liquid from the developed liquid image. However, such removal must be carried out in a manner that results in minimum degradation of the toner particles forming the liquid image. The conditioned image is then subsequently transferred to a receiver which may be an intermediate transfer belt and then to a recording or copy sheet for fusing to form a hard copy.

Liquid electrophotographic reproduction machines as such can produce single color images or multicolor images on such a recording or copy sheet. The quality or acceptability of a color copy produced as such is ordinarily a function on how the human eye and mind receives and perceives the colors of the original and compares it to the colors of the copy. The human eye has three color receptors that sense red light, green light, and blue light. These colors are known as the three primary colors of light. These colors can be reproduced by one of two methods, additive color mixing and subtractive color mixing, depending on the way the colored object emits or reflects light.

In the method of additive color mixing, light of the three primary colors is projected onto a white screen and mixed together to create various colors. A well known exemplary device that uses the additive color method is the color television. In the subtractive color method, colors are created from the three colors yellow, magenta and cyan, that are complementary to the three primary colors. The method involves progressively subtracting light from white light. Examples of subtractive color mixing are color photography and color reproduction. Also, it has been found that electrophotographic reproduction machines are capable of building up a full subtractive color image from cyan, magenta, yellow and black. They can produce a subtractive color image by one of three methods.

One method is to transfer the developed image of each color on an intermediary, such as a belt or drum, then transferring all the images superimposed on each other on a sheet of copy paper.

A second method involves developing and transferring an image onto a sheet of copy paper, then superimposing a second and subsequent images onto the same sheet of copy paper. Typically an image processing system using this method can produce a first color image by developing that color image on a photoconductive surface, transferring the image onto a sheet of copy paper, and then similarly and sequentially producing and superimposing a second, and subsequent images onto the same sheet of copy paper.

A third method utilizes what is referred to as a Recharge, Expose, and Develop or REaD process. In this process, the light reflected from the original is first converted into an electrical signal by a raster input scanner (RIS), subjected to image processing, then reconverted into a light, pixel by pixel, by a raster output scanner (ROS) which exposes the charged photoconductive surface to record a latent image thereon corresponding to the subtractive color of one of the colors of the appropriately colored toner particles at a first development station. The photoconductive surface with the developed image thereon is recharged and re-exposed to record the latent image thereon corresponding to the subtractive primary of another color of the original. This latent image is developed with appropriately colored toner. This process (REaD) is repeated until all the different color toner layers are deposited in superimposed registration with one another on the photoconductive surface. The multi-layered toner image is transferred from the photoconductive surface to a sheet of copy paper. Thereafter, the toner image is fused to the sheet of copy paper to form a color copy of the original.

Liquid developers when utilized in machines making single color (black and white) images or multicolor images according to any of the above methods, have many advantages over dry developer materials or toners. For example, liquid developers often result in images of higher quality than images formed with dry toners. Liquid toner particles can usually be made relatively very small without resulting in problems often associated with small particle powder toners, problems such as machine dirt which can adversely affect process reliability. Development with liquid developers in full color imaging processes also has many advantages, such as a texturally attractive print because there is substantially no height buildup, whereas full color images developed with dry toners often exhibit height build-up of the image where color areas overlap. Further, full color prints made with liquid developers can be made to a uniformly glossy or a uniformly matte finish, whereas uniformity of finish is difficult to achieve with powder toners because of variations in the toner pile height, the need for thermal fusion, and the like.

As disclosed for example in U.S. Pat. No. 5,028,964 liquid toner images formed by any of the methods above are usually transfixed, that simultaneously heated while being transferred, onto a copy sheet. Unfortunately, it has been found that some liquid toner image copies, such as those formed on coated sheets of paper, merely by transfixing as above, exhibit significantly poor abrasion fix levels. Such images particularly when transfixed in the absence of residual hydrocarbon carrier liquid have significant fix level problems. Although "crease" fix levels are relatively acceptable, "abrasion" fix level results (e.g., results as measured by an eraser test) are relatively low and unacceptable. In the case of such images produced for example by an Indigo E-1000 liquid developer machine, abrasion fix levels on coated papers are so low the transfixed images can be easily erased off the coated paper.

SUMMARY OF THE INVENTION

In accordance with the present invention, there is provided a liquid electrophotographic reproduction machine for producing a toner image reproduction on a copy sheet. The reproduction machine includes an image bearing member movable along a process path, latent image forming devices mounted along the process path for forming a latent image electrostatically on the image bearing member, and a development unit. The development unit is mounted along the process path and contains liquid developer material including a liquid carrier and charged dispersed toner particles for developing the latent image to form a toner image. The reproduction machine also includes a transfix assembly mounted along the process path for transferring and simultaneously heating and fixing the toner image onto a copy sheet. In order to increase the abrasion fix level of produced toner image copies, the reproduction machine further includes a separate fusing apparatus mounted downstream of the transfix assembly relative to copy sheet movement for selectively and additionally heating and pressurizing the transfixed image onto the copy sheet.

DESCRIPTION OF THE DRAWINGS

Other aspects of the present invention will become apparent as the following description proceeds and upon reference to the drawings, in which.

DETAILED DESCRIPTION OF THE INVENTION

Figure 1:
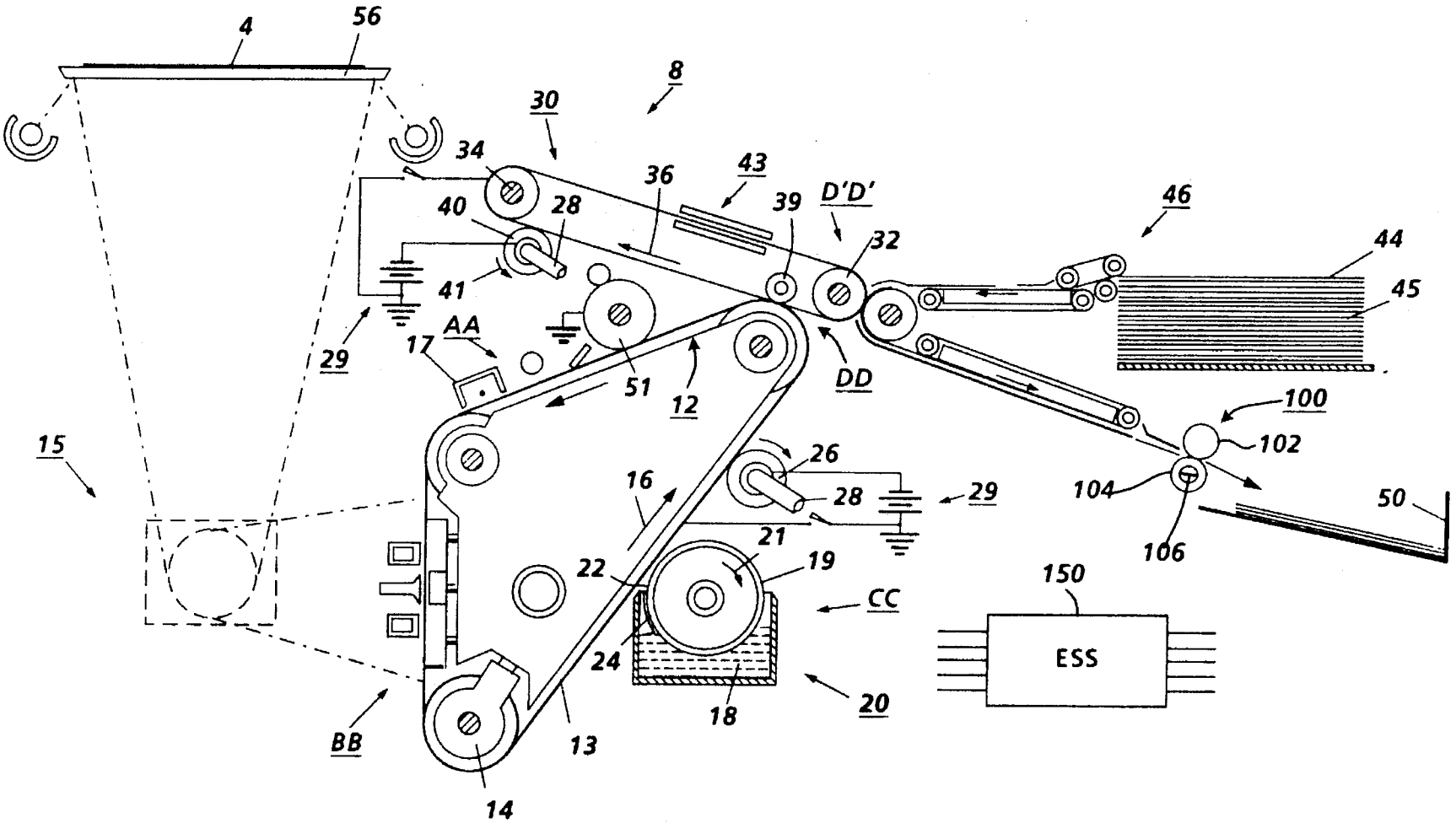
FIG. 1 is a schematic, elevational view of a single color black and white electrophotographic liquid toner reproduction machine incorporating a post-transfix fusing apparatus in accordance with the present invention.

For a general understanding of the features of the present invention, reference numerals have been used throughout to designate identical elements. It will become evident from the following discussion that the present invention is equally well suited for use in a wide variety of reproduction machines and is not necessarily limited in its application to the particular embodiment depicted herein.

Inasmuch as the art of electrophotographic reproduction is well known, the various processing stations employed in the FIGS. 1 and 2 reproduction machines will be shown hereinafter only schematically, and their operation described only briefly.

Referring to FIG. 1, there is shown a reproduction machine 8 employing a belt 12 including a photoconductive surface 13 deposited on a conductive substrate. A roller 14 rotates and advances belt 12 in the direction of arrow 16. Belt 12 passes through charging station AA where a corona generating device 17 charges the photoconductive surface 13 of the belt 12 a portion at a time to a high and generally uniform potential. The charged portions of belt 12 are advanced sequentially to an exposure station BB where image rays from an original document 4 on a transparent platen 56 are projected by means of an optical system 15 onto the charged portion of the photoconductive surface so as to record an electrostatic latent image. Alternatively as is well known, a raster output scanner (ROS) device (not shown) can be used to write a latent image bitmap from digital electronic data by selectively erasing charges in areas of a charged portion on the charged belt 12. Such a ROS device writes the image data pixel by pixel in a line screen registration mode. In either case, it should be noted that the latent image can be thus formed for a discharged area development (DAD) process machine in which discharged areas are developed with toner, or for a charged area development (CAD) process machine in which the charged areas are developed with toner.

After the electrostatic latent image has been recorded thus, belt 12 advances to development station CC where a liquid developer material 18 including liquid carrier and charged toner particles from a chamber of a development apparatus 20 is advanced through a development zone or nip 22. At development station CC, a developer roller 19 rotating in the direction of arrow 21 advances liquid developer material 18 through the nip 22. An electrode 24 positioned before an entrance into development nip 22 is electrically biased so as to disperse the toner particles as solids in a substantially uniformly manner throughout the liquid carrier. Development station CC also includes a porous blotter roller 26 having perforations through the skin surface thereof. Roller 26 is mounted so as to contact the liquid toner developed image on belt 12, and so as to condition the liquid image by reducing its fluid content (thereby increasing its percent solids) while at the same time inhibiting the departure of toner particles from the image. The roller 26 operates in conjunction with a vacuum device 28 for removing the liquid carrier from the liquid toner image. A bias voltage 29 is applied to roller 26 so that a repelling force is present to prevent toner particles from leaving the photoconductive surface and entering the roller 26.

After the electrostatic latent image is developed, belt 12 advances the developed image to transfer station DD where the developed liquid image is electrostatically transferred from belt 12 to an intermediate member or belt 30. As shown, belt 30 is entrained about rollers 32 and 34, and is moved in the direction of arrow 36. A bias transfer roller 39 urges intermediate transfer belt 30 against image bearing belt 12 in order to assure effective transfer of the conditioned liquid toner image from belt 12 to the intermediate belt 30. A second porous blotter roller 40, having perforations through the roller skin covering, also then contacts the transferred image on belt 30 to further reduce its fluid content (increasing its percent solids) while preventing toner particles from departing from the image. The roller 40 by further removing excess liquid carrier as such increases the percent solids to between 25 and 75.% by weight, for example.

Increasing the percent solids of the transferred liquid toner image on the intermediate belt 30 is a particularly important function in a liquid color image developing process that utilizes multiple superimposed images of different colors.

In operation, roller 40 rotates in the direction of arrow 41 to impinge against the liquid toner image image on belt 30. The porous body of roller 40 absorbs liquid from the surface of the transferred image. The absorbed liquid permeates through roller 40 and into an inner hollow cavity thereof, where the vacuum device 28 draws such liquid out of the roller 40 and into a liquid receptacle for subsequent disposal or recirculation as liquid carrier. Porous roller 40 then continues to rotate in the direction of arrow 41 to ensure continuous absorption of excess liquid from liquid toner images on transfer belt 30. A bias voltage 29 is applied to the roller 40 to establish a repelling electrostatic field against charged toner particles forming the images, thereby preventing such toner particles from transferring to the roller 40.

Belt 30 then advances the transferred image through a heating device 43 to a second transfer station D'D' where a sheet of support material 44 is advanced from stack 45 of such sheets by a sheet transport mechanism 46. The transferred image from the photoconductive surface of belt 30 is then attracted or transferred to copy sheet 44. After such transfer a, conveyor belt 46 moves the copy sheet 44 to a discharge output tray 50. As shown, after toner image transfer at transfer station DD, a cleaning device 51 including a roller formed of suitable material is driven into scrubbing engagement with the surface 13 of belt 12 in order to clean the surface 13.

Figure 2:
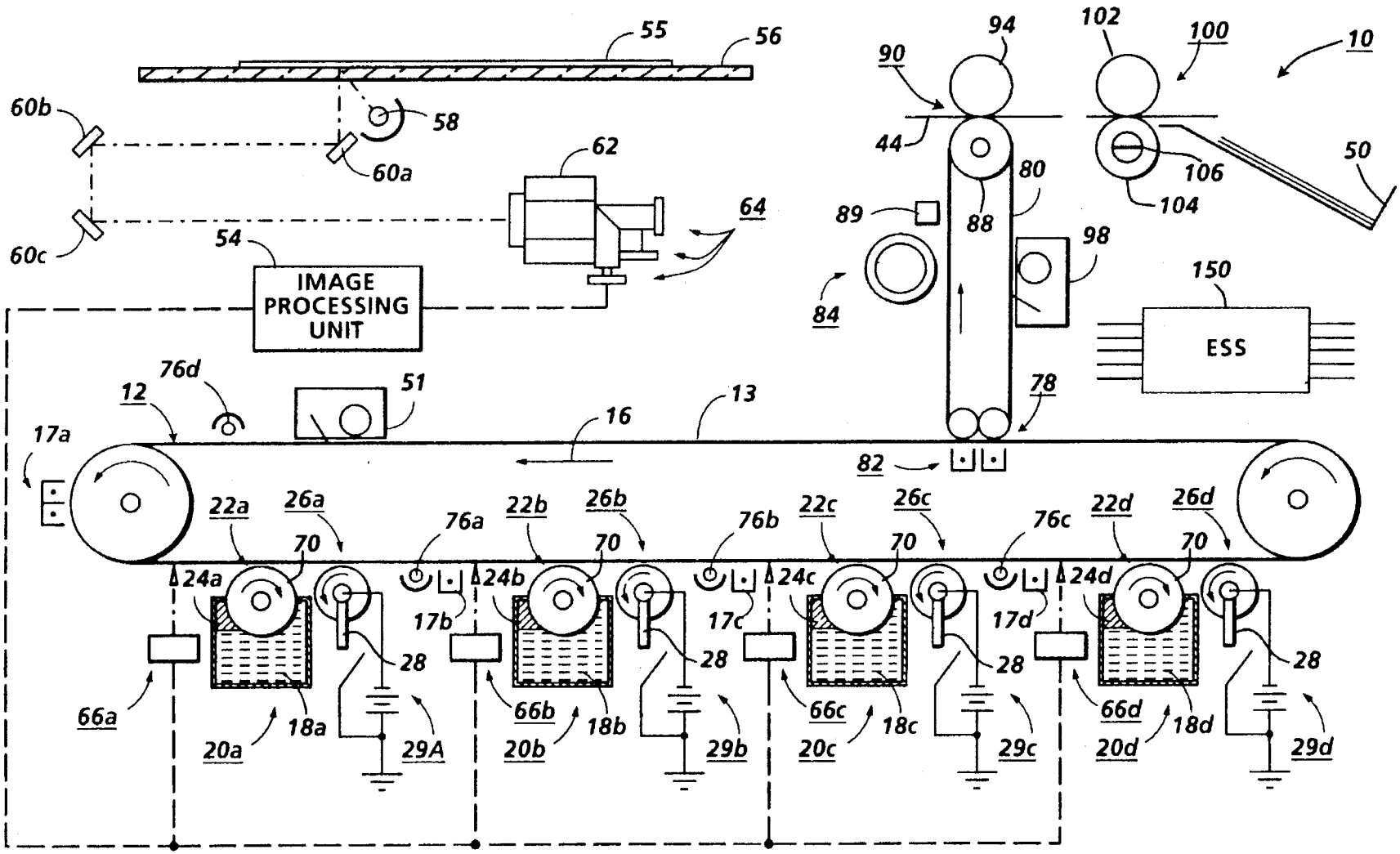
FIG. 2 is a color electrophotographic liquid toner reproduction machine incorporating a post-transfix fusing apparatus in accordance with the present invention the present invention.

Turning now to FIG. 2, there is shown a color electrophotographic reproduction machine 10 incorporating post-transfix fusing apparatus of the present invention. The color copy process of the machine 10 can begin by either inputting a computer generated color image into an image processing unit 54 or by way of example, placing a color document 55 to be copied on the surface of a transparent platen 56. A scanning assembly consisting of a halogen or tungsten lamp 58 which is used as a light source, and the light from it is exposed onto the color document 55. The light reflected from the color document 55 is reflected, for example, by a 1st, 2nd, and 3rd mirrors 60*a*, 60*b* and 60*c*, respectively through a set of lenses (not shown) and through a dichroic prism 62 to three charged-coupled devices (CCDs) 64 where the information is read. The reflected light is separated into the three primary colors by the dichroic prism 62 and the CCDs 64. Each CCD 64 outputs an analog voltage which is proportional to the intensity of the incident light. The analog signal from each CCD 64 is converted into an 8-bit digital signal for each pixel (picture element) by an analog/digital converter (not shown). Each digital signal enters an image processing unit 54. The digital signals which represent the blue, green, and red density signals are converted in the image processing unit 54 into four bitmaps: yellow (Y), cyan (C), magenta (M), and black (Bk). The bitmap represents the value of exposure for each pixel, the color components as well as the color separation. Image processing unit 54 may contain a shading correction unit, an undercolor removal unit (UCR), a masking unit, a dithering unit, a gray level processing unit, and other imaging processing sub-systems known in the art. The image processing unit 54 can store bitmap information for subsequent images or can operate in a real time mode.

The machine 10 includes a photoconductive imaging member or photoconductive belt 12 which is typically multilayered and has a substrate, a conductive layer, an optional adhesive layer, an optional hole blocking layer, a charge generating layer, a charge transport layer, a photoconductive surface 13, and, in some embodiments, an anti-curl backing layer. As shown, belt 12 is movable in the direction of arrow 16. The moving belt 12 is first charged by a charging unit 17*a*. A raster output scanner (ROS) device 66*a*, controlled by image processing unit 54, then writes a first complementary color image bitmap information by selectively erasing charges on the charged belt 12. The ROS 66*a* writes the image information pixel by pixel in a line screen registration mode. It should be noted that either discharged area development (DAD) can be employed in which discharged portions are developed or charged area development (CAD) can be employed in which the charged portions are developed with toner.

After the electrostatic latent image has been recorded thus, belt 12 advances the electrostatic latent image to development station 20*a*. At development station 20*a*, a development roller 70, rotating in the direction as shown, advances a liquid developer material 18*a*, preferably black toner developer material, from the chamber of a development housing to a development zone or nip 22*a*. An electrode 24*a* positioned before the entrance to development zone or nip 22*a* is electrically biased to generate an AC field just prior to the entrance to development zone or nip 22*a* so as to disperse the toner particles substantially uniformly throughout the liquid carrier. The toner particles, disseminated through the liquid carrier, pass by electrophoresis to the electrostatic latent image. As is well known, the charge of the toner particles is opposite in polarity to the charge on the photoconductive surface 13.

Liquid developer materials suitable for the color machine 10 generally comprise a liquid vehicle, toner particles, and a charge control additive. The liquid medium may be any of several hydrocarbon liquids conventionally employed for liquid development processes, including hydrocarbons, such as high purity alkanes having from about 6 to about 14 carbon atoms, such as Norpar® 12, Norpar® 13, and Norpar® 15, available from Exxon Corporation, and including isoparaffinic hydrocarbons such as Isopar® G, H, L, and M, available from Exxon Corporation, Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons are preferred liquid media, since they are colorless, environmentally safe, and possess a sufficiently high vapor pressure so that a thin film of the liquid evaporates from the contacting surface within seconds at ambient temperatures. Generally, the liquid medium is present in a large amount in the developer composition, and constitutes that percentage by weight of the developer not accounted for by the other components. The liquid medium is usually present in an amount of from about 80 to about 98 percent by weight, although this amount may vary from this range provided that the objectives of the present invention are achieved.

The toner particles can be any colored particle compatible with the liquid medium or carrier. For example, the toner particles can consist solely of pigment particles, or may comprise a resin and a pigment; a resin and a dye; or a resin, a pigment, and a dye. Suitable resins include poly(ethyl acrylate-co-vinyl pyrrolidone), poly(N-vinyl-2-pyrrolidone), and the like. Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, Ajax, Ontario, Bismark Brown R (Aldrich), Neolan Blue (Ciba-Geigy), Savinyl Yellow RLS, Black RLS, Red 3GLS, Pink GBLS, all available from Sandoz Company, Mississauga, Ontario, and the like. Dyes generally are present in an amount of from about 5 to about 30 percent by weight of the toner particle, although other amounts may be present.

Suitable pigment materials include carbon blacks such as Microlith®CT, available from BASF, Printex® 140 V, available from Degussa, Raven® 5250 and Raven® 5720, available from Columbian Chemicals Company. Pigment materials may be colored, and may include magenta pigments such as Hostaperm Pink E (American Hoechst Corporation) and Lithol Scarlet (BASF), yellow pigments such as Diarylide Yellow (Dominion Color Company), cyan pigments such as Sudan Blue OS (BASF), and the like. Generally, any pigment material is suitable provided that it consists of small particles and that it combines well with any polymeric material also included in the developer composition. Pigment particles are generally present in amounts of from about 5 to about 40 percent by weight of the toner particles, and preferably from about 10 to about 30 percent by weight. The toner particles should have an average particle diameter from about 0.2 to about 10 microns, and preferably from about 0.5 to about 2 microns. The toner particles may be present in amounts of from about 1 to about 10, and preferably from about 2 to about 4 percent by weight of the developer composition.

Examples of suitable charge control agents include lecithin (Fisher Inc.); OLOA 1200, a polyisobutylene succinimide available from Chevron Chemical Company; basic barium petronate (Witco Inc.); zirconium octoate (Nuodex); aluminum stearate; salts of calcium, manganese, magnesium and zinc; heptanoic acid; salts of barium, aluminum, cobalt, manganese, zinc, cerium, and zirconium octoates; salts of barium, aluminum, zinc, copper, lead, and iron with stearic acid; and the like. The charge control additive may be present in an amount of from about 0.01 to about 3 percent by weight, and preferably from about 0.02 to about 0.05 percent by weight of the developer composition.

After the first liquid color separation image is developed, for example with black liquid toner, it is conditioned by a conditioning porous roller 26*a*, 26*b*, 26*c*, 26*d* having perforations through the roller skin covering. Roller 26*a* contacts the developed image on belt 12 and conditions the image by compacting the toner particles of the image and reducing the fluid content thereof (thus increasing the percent solids) while inhibiting the departure of toner particles from the image. Consistent with FIG. 1 (see page 6, lines 22–24 above), a bias voltage 29*a*, 29*b*, 29*c*, 29*d* is applied respectively to the conditioning roller 26*a*, 26*b*, 26*c*, 26*d*. Preferably, the percent solids in the developed image is increased to more than 20 percent by weight. Porous roller 26*a*, 26*b*, 26*c*, 26*d* operates in conjunction with a vacuum 28 which removes liquid from the roller. A pressure roller (not shown), mounted in pressure contact against the blotter roller 26*a*, may be used in conjunction with or in the place of the vacuum device 28, to squeeze the absorbed liquid carrier from the blotter roller for deposit into a receptacle.

In operation, roller 26*a*, 26*b*, 26*c*, 26*d* rotates in direction as shown to impose against the "wet" image on belt 12. The porous body of roller 26*a*, 26*b*, 26*c*, 26*d* absorbs excess liquid from the surface of the image through the skin covering pores and perforations. Vacuum device 28 located on one end of a central cavity of the roller 26*a*, 26*b*, 26*c*, 26*d*, draws liquid that has permeated into the roller, out through the cavity. Vacuum device 28 deposits the liquid in a receptacle or some other location for either disposal or recirculation as liquid carrier. Porous roller 26*a*, 26*b*, 26*c*, 26*d* then, continues to rotate in the direction as shown to provide a continuous absorption of liquid from the image on belt 12. The image on belt 12 advances to lamp 76*a* where any residual charge left on the photoconductive surface 13 of belt 12 is erased by flooding the photoconductive surface with light from lamp 76*a*.

As shown, according to the REaD process of the machine 10, the developed latent image on belt 12 is subsequently recharged with charging unit 17*b*, and is next re-exposed by ROS 66*b*. ROS 66*b* superimposing a second color image bitmap information over the previous developed latent image. Preferrably, for each subsequent exposure an adaptive exposure processor is employed that modulates the exposure level of the raster output scanner (ROS) for a given pixel as a function of toner previously developed at the pixel site, thereby allowing toner layers to be made independent of each other. Also, during subsequent exposure, the image is re-exposed in a line screen registration oriented along the process or slow scan direction. This orientation reduces motion quality errors and allows the utilization of near perfect transverse registration. At development station 20*b*, a development roller 70, rotating in the direction as shown, advances a liquid developer material 18*b* from the chamber of development housing to development a zone or nip 22*b*. An electrode 24*b* positioned before the entrance to development zone or nip 22*b* is electrically biased to generate an AC field just prior to the entrance to development zone or nip 22*b* so as to disperse the toner particles substantially uniformly throughout the liquid carrier. The toner particles, disseminated through the liquid carrier, pass by electrophoresis to the previous developed image. The charge of the toner particles is opposite in polarity to the charge on the previous developed image.

A second conditioning roller 26*b* contacts the developed image on belt 12 and conditions the image by by compacting the toner particles of the image and reducing fluid content while inhibiting the departure of toner particles from the image. Preferrably, the percent solids is more than 20 percent, however, the percent of solids can range between 15 percent and 40 percent. The images on belt 12 advances to lamp 76*b* where any residual charge left on the photoconductive surface is erased by flooding the photoconductive surface with light from lamp 76.

To similarly produce the third image using the third toner color, for example magenta color toner, the developed images on moving belt 12 are recharged with charging unit 17*c*, and re-exposed by a ROS 66*c*, which superimposes a third color image bitmap information over the previous developed latent image. At development station 20*c*, development roller 70, rotating in the direction as shown, advances a magenta liquid developer material 18*c* from the chamber of development housing to a development zone or nip 22*c*. An electrode 24*c* positioned before the entrance to development zone or nip 22*c* is electrically biased to generate an AC field just prior to the entrance to development zone or nip 22*c* so as to disperse the toner particles substantially uniformly throughout the liquid carrier. The toner particles, disseminated through the liquid carrier, pass by electrophoresis to the previous developed image. A conditioning roller 26*c* contacts the developed images on belt 12 and conditions the images by reducing fluid content so that the images have a percent solids within a range between 15 percent and 40 percent. The images or composite image on belt 12 advances to lamp 76*c* where any residual charge left on the photoconductive surface of belt 12 is erased by flooding the photoconductive surface with light from the lamp.

Finally, to similarly produce the fourth image using the fourth toner color, for example cyan color toner, the developed images on moving belt 12 are recharged with charging unit 17*d*, and re-exposed by a ROS 66*d*. ROS 66*d* superimposes a fourth color image bitmap information over the previous developed latent images. At development station 20*d*, development roller 70, rotating in the direction as shown, advances a cyan liquid developer material 18*d* from the chamber of development housing to a development zone or nip 22*d*. An electrode 24*d* positioned before the entrance to development zone or nip 22*d* is electrically biased to generate an AC field just prior to the entrance to development zone or nip 22*d* so as to disperse the toner particles substantially uniformly throughout the liquid carrier. The toner particles, disseminated through the liquid carrier, pass by electrophoresis to the previous developed image. A conditioning roller 26*d* contacts the developed images on belt 12 and conditions the images by reducing fluid content so that the images have a percent solids within a range between 15 percent and 40 percent.

The resultant composite multicolor image, a multi layer image by virtue of different color toner development by the developing stations 20*a*, 20*b*, 20*c* and 20*d*, respectively having black, yellow, magenta, and cyan, toners, is then advanced to an intermediate transfer station 78. It should be evident to one skilled in the art that the color of toner at each development station could be in a different arrangement.

At the transfer station 78, the resultant multicolor liquid image is subsequently electrostatically transferred to an intermediate member 80 with the aid of a charging device 82. Intermediate member 80 may be either a rigid roll or an endless belt, as shown, having a path defined by a plurality of rollers in contact with the inner surface thereof. It is preferred that intermediate member 80 comprise at least a two layer structure in which the substrate layer has a thickness greater than 0.1 mm and a resistivity of $10^6$ ohm-cm. An insulating top layer has a thickness less than 10 micron, a dielectric constant of 10, and a resistivity of $10^{13}$ ohm-cm. The top layer also has an adhesive release surface. Also, it is preferred that both layers each have a matching hardness less than 60 durometer. Preferably, both layers are composed of Viton™ (a fluoroelastomer of vinylidene fluoride and hexafluoropropylene) which can be laminated together.

The multicolor image on the intermediate transfer member 80 is conditioned again for example by a blotter roller 84 which reduces the fluid content of the transferred image by compacting the toner particles of the image while inhibiting the departure of toner particles from the image. Blotter roller 84 is adapted to condition the image so that it has a toner composition of more than 50 percent solids.

Subsequently, the multicolor image on the surface of the intermediate member 80 is advanced through a liquefaction stage before being transferred within a second transfer nip 90 to an image recording sheet 44. Within the liquefaction stage, particles of toner forming the transferred image are transformed by a heat source 88 into a tackified or molten state. The heat source 88 can be applied to member 80 internally, for example. Preferably, the tackified toner particle image is then transferred, and bonded, to recording sheet 44 with limited wicking by the sheet. More specifically, the liquefaction stage also includes an external heating element 89 which heats the external surface of the intermediate member 80 within a transfix nip 90 and to a temperature sufficient to cause the toner particles present on such surface to melt. The toner particles on the surface, while softening and coalescing due to the application of such heat internally and externally of the intermediate transfer member 80, ordinarily maintain the position in which they were deposited on the outer surface of member 80, thereby not altering the image pattern which they represent.

Within the transfixing nip 90, the multicolor image is not only transferred to the recording sheet 44, but it is also expected to be fused or fixed to acceptable fix levels by the application of appropriate heat and pressure. For example, at transfix nip 90, the liquefied toner particles are heated to a temperature of 80 to 100 degrees C., and are forced by a normal force applied through a backup pressure roll 94, into contact with the surface of recording sheet 44. Moreover, recording sheet 44 may have a previously transferred toner image present on a surface thereof as the result of a prior imaging operation, i.e. duplexing. The normal force, produces a nip pressure which is preferably about 20 psi, and may also be applied to the recording sheet via a resilient blade or similar spring-like member uniformly biased against the outer surface of the intermediate member across its width. Transfixing as such is ordinarily done at a high enough temperature so as to drive off virtually all the residual hydrocarbon carrier liquid. After such transfixing, the effective viscosity of the "dry" image is usually very high, and therefore adhesion of the image to paper, especially coated paper, is poor and unacceptable.

It should be noted that transfixing (i.e. hot transferring) of liquid toner images is necessary. This is because ordinarily if such transfer is done cold, the image does not transfer well, usually resulting in incomplete, blotchy transfer which causes totally unacceptable image quality. It has been found that if relatively large levels (about 50 to 75%) of residual high-boiling hydrocarbon carrier liquids are left in the toner image, fix levels can be much improved. However, this may not always be possible, especially if a low-boiling carrier liquid is used and boiled off prior to transfix when reducing its content in order to minimize its carry-out onto the paper.

Cold transfer could be accomplished only when the liquid toner image image still contains about 75% or more of the hydrocarbon carrier fluid. Such a high liquid content is of course unacceptable for subsequent processing reasons as well as for customer satisfaction and environmental reasons. As such, it is understandable that such poor fixing results of the final copy ordinarily occurs when there is an inadequate level of residual hydrocarbon carrier liquid in the toner image, regardless of the type of paper used. On the other hand, even when there is adequate residual carrier liquid in the toner image transfixed, poor fixing of the final copy can still be obtained on some coated papers due to insufficient heating.

As the recording sheet 44 passes through the transfix nip 90 the tackified toner particles wet the surface of the recording sheet, and due to greater attractive forces between the paper and the tackified particles, as compared to the attraction between the tackified particles and a liquid-phobic surface of member 80, the tackified particles are completely transferred to the recording sheet 44. Furthermore, the transfixed image becomes permanent once allowed to cool below their melting temperature. As shown, the surface of the intermediate transfer belt 80 is thereafter cleaned by a cleaning device 98 prior to receiving another toner image from the belt 12.

Therefore, in accordance with the present invention, a separate fusing apparatus 100 is provided downstream of the conventional transfix nip D'D' (FIG. 1), 90 for further heating and pressurizing the transfixed toner image onto the sheet 44. The separate fusing apparatus 100 is useful both in a black and white liquid developer machine 8 (FIG. 1) and particularly in a color machine such as the machine 10. In each machine, it is useful in assuring good fix of images regardless of the cause of fix failure. Although some heating and transfer are simultaneously achieved in the transfix nip 90, combining these functions does not allow for complete optimization of either. This is particularly a problem for high-quality high-speed printing, which is the primary goal of liquid development machines. Optimization of the functions when the separate fusing apparatus 100 is used for example allows for a lower transfix temperature which reduces concerns about damage to the photoreceptor belt 12. It makes unnecessary to cool the intermediate belt 30, and more importantly, the transfix process can now be independently optimized for transfer performance, a separate fusing apparatus also provides an additional level of gloss control, which might be important in production color printing, where customers are accustomed to specifying the gloss level.

As shown, the separate fusing apparatus 100 includes a pressure roller 102 and a heated fuser roller 104 forming a fusing nip. The fuser roller 104 can be heated internally for example by a lamp 106. In order to maintain a relatively higher carrier liquid content in the transfixed image and prevent temperature damage to the photoreceptor, preferably, a desired fusing temperature of the fusing apparatus 100 is within a range of 100° C. to 200° C., preferably at 150° C., and is thus higher than a desired temperature of the transfix nip 90 at 100° C. or lower.

Referring to FIGS. 1 and 2, each machine 8, 10 includes an electronic control subsystem (ESS) 150 that has programmable means, as are well known, for controlling the subcomponents and various aspects of the machine 8, 10. According to the present invention, the ESS 150 can be programmed to selectively control the fusing apparatus 100 to additionally heat and pressurize toner images transfixed onto only special paper sheets, such as coated paper and transparency sheets.

The possibility of improving fix on coated paper was tested, using a color type fusing apparatus. The test images, made from cyan color liquid toner, and were merely transfixed conventionally to special coated paper that is one of the most difficult papers to get good fix with Liquid toner images, by a bench process. The transfer process used enabled "dry" toner images with essentially no residual high-boiling hydrocarbon carrier in the toner images. The conventional results showed "abrasion" fix of these images to be so low that the image could be easily wiped off this paper with a cotton swap.

These test images were then run through the separate fusing apparatus, such as the apparatus 100 in accordance with the present invention at a relatively low temperature 125° C. to 150° C. (i.e. 257° F. to 302° F.). It is believed that in a full scale machine this range is more like 100° C. to 200° C., and a preferred point therefor is at 150° C. Advantageously, the fused images showed a large improvement in abrasion fix. The images could still be erased with an eraser(great improvement over a cotton swap), but so much effort was required to erase them at the higher fusing temperatures that the paper was damaged in the process. These transfixed and fused images probably represent the best fix that can be achieved with liquid toner images on coated papers.

Invariably, after the multicolor image was transferred from the belt 12 to intermediate member 80, residual liquid developer material remained adhering to the photoconductive surface of belt 12. A cleaning device 51 including a roller formed of any appropriate synthetic resin, is therefore driven in a direction opposite to the direction of movement of belt 12 to scrub the photoconductive surface clean. It is understood, however, that a number of photoconductor cleaning means exist in the art, any of which would be suitable for use with the present invention. Any residual charge left on the photoconductive surface after such cleaning is erased by flooding the photoconductive surface with light from a lamp **76*d* prior to again charging the belt 12** for producing another multicolor image as above.

It is, therefore, evident that there has been provided, in accordance with the present invention, a black and white and a full color, high speed reproduction machine each including the separate, function optimizing fusing apparatus that fully satisfies the aims and advantages the present invention. While this invention has been described in conjunction with one embodiment thereof, it is evident that many alternatives, modifications and variations will be apparent to those skilled in the art. Accordingly, it is intended to embrace all such alternatives, modification and variations as fall within the spirit and broad scope of the appended claims.

We claim:

1. A liquid electrophotographic reproduction machine comprising:

(a) an image bearing member movable along a process path;

(b) latent image means mounted along the process path for forming a latent image electrostatically on said image bearing member;

(c) a development unit mounted along the process path and containing liquid developer material including a liquid carrier and dispersed charged toner particles for developing the latent image to form a toner image;

(d) transfix means having a first temperature and forming a transfix nip with said image bearing member for transferring and heat fixing the toner image as a transfixed image onto an image receiver sheet; and (e) a separate fusing apparatus mounted downstream of said transfix nip relative to movement of the receiver sheet and having a second temperature for selectively and additionally heating and pressurizing the transfixed image onto the receiver sheet to create an image copy having a relatively high abrasion fix level, said second temperature of said fusing apparatus being higher than said first temperature of said transfix means.

2. The liquid electrophotographic reproduction machine of claim 1, including control means for selectively controlling said fusing apparatus to additionally heat and pressurize toner images transfixed onto coated paper.

3. The liquid electrophotographic reproduction machine of claim 1, including control means for selectively controlling said fusing apparatus to additionally heat and pressurize toner images transfixed onto transparency sheets.

4. The liquid electrophotographic reproduction machine of claim 1, wherein said second fusing temperature of said fusing apparatus is within a range of 100° C. to 200° C.

5. The liquid electrophotographic reproduction machine of claim 4, wherein said second fusing temperature of said fusing apparatus is preferably at 150° C.

* * * * *